US006244616B1

(12) United States Patent
Arduin et al.

(10) Patent No.: US 6,244,616 B1
(45) Date of Patent: Jun. 12, 2001

(54) INTERFACE DEVICE BETWEEN A BOOT AND AN ALPINE SKI

(75) Inventors: Joël Arduin, Metz-Tessy; Jean-Paul Mousselard, Poisy; Gilles Silva, Le Montcel, all of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/438,410

(22) Filed: Nov. 12, 1999

(30) Foreign Application Priority Data

Nov. 13, 1998 (FR) ..... 98 14602

(51) Int. Cl.[7] ..... A63C 5/07
(52) U.S. Cl. ..... 280/602; 280/607
(58) Field of Search ..... 280/601, 602, 280/607, 617, 618, 14.21, 636

(56) References Cited

U.S. PATENT DOCUMENTS

| | | | | |
|---|---|---|---|---|
| 3,797,839 | * | 3/1974 | Smolka et al. | 280/617 |
| 3,797,844 | * | 3/1974 | Smolka et al. | 280/607 |
| 4,896,895 | | 1/1990 | Bettosini | 280/607 |
| 5,242,188 | * | 9/1993 | Bigler et al. | 280/607 |
| 5,342,078 | | 8/1994 | Stepanek et al. | 280/602 |
| 5,344,176 | * | 9/1994 | Trimble | 280/602 |
| 5,480,175 | | 1/1996 | Astier et al. | 280/607 |
| 5,492,356 | | 2/1996 | Astier et al. | 280/602 |
| 5,647,605 | | 7/1997 | Arduin | 280/602 |
| 5,655,787 | * | 8/1997 | Piegay | 280/607 |
| 5,746,439 | | 5/1998 | Boehm et al. | 280/602 |
| 5,758,894 | * | 6/1998 | Maggiolo | 280/602 |
| 5,845,923 | * | 12/1998 | Zanco | 280/607 |
| 5,927,743 | | 7/1999 | Mantel | 280/602 |
| 6,056,310 | * | 5/2000 | Hangl | 280/607 |

FOREIGN PATENT DOCUMENTS

| | | | | |
|---|---|---|---|---|
| 0564767 | | 10/1993 | (EP) . | |
| 0599041 | | 6/1994 | (EP) . | |
| 602350 | * | 6/1994 | (EP) | 280/607 |
| 0623370 | | 11/1994 | (EP) . | |
| 0780143 | | 6/1997 | (EP) . | |
| 0880981 | | 12/1998 | (EP) . | |
| WO83/03360 | | 10/1983 | (WO) . | |
| 95/00217 | * | 1/1995 | (WO) | 280/602 |

* cited by examiner

*Primary Examiner*—Frank Vanaman
(74) *Attorney, Agent, or Firm*—Greenblum & Bernstein, P.L.C.

(57) ABSTRACT

An interface device including a rear wedge and a front wedge connected by a link. The front zone of the rear wedge is integrally connected to the ski. The front wedge is mounted to float on a plate. The front wedge and the plate cooperate by means of inclined surfaces. An elastically deformable cushion is inserted between the front wedge and plate. The link is attached to the rear wedge by a fold pressing against the surface of a housing of the wedge. In the front, the link is attached by a screw-nut system adjustable in length along the link and engaged in a housing of the wedge.

10 Claims, 2 Drawing Sheets

INTERFACE DEVICE BETWEEN A BOOT AND AN ALPINE SKI

BACKGROUND OF THE INVENTION

1. Field of the Invention

The invention is directed to an interface device between a boot and a ski, preferably an alpine ski. The invention also concerns an assembly for retaining a boot on a ski having such an assembly, as well as a ski equipped with such a retention assembly.

2. Description of Background and Relevant Information

In a manner known in the art, skis are equipped with an interface device between the boot and the boot retention elements to modify the bending characteristics of the ski.

For example, Patent Application No. WO 83/03360 describes a plate that is raised relative to the top surface of the ski. The plate supports the two boot retention elements. One of its ends is integrally connected to the ski, the other end is free, and blocks of elastically deformable material counter its displacement during bending of the ski with progressive resistance.

This device yields good results. Nevertheless, the influence it exerts on the ski varies in intensity with the bending of the ski but not in nature. In other words, the device stiffens certain zones of the ski in a variable manner, without displacing the zone of the ski where it exerts its action, depending on the bending of the ski. Moreover, with strong bends of the ski, the plate has a tendency to arch.

In Patent Application No. EP 623 370, an interface device of the same type is known where the front end of the plate cooperates with a fixed stop on the ski according to different functional systems which follow one other as the ski bends. This device, although delicate to adjust, yields good results, but the various zones of the ski where it successively exerts its action are not the most suitable zones.

Moreover, in known devices, the reaction to the thrust of the rear retention element is picked up by the plate such that it is always isolated from the ski.

And finally, Patent Application No. EP 599 041 describes a device where the two retention elements are mounted on separate supports. The rear element is mounted on a plate of which the rear end has limited freedom to slide relative to a stop integrated into the ski, and where the front end of the plate extends in front of the front support and presses against it under the effect of the recoil thrust. When the ski bends, the recoil thrust is directed toward the front support as long as the rear end of the plate is free to slide.

This device also yields good results, but the zones of the ski affected by its action are not optimized. Moreover, its functioning is not very progressive. Finally, to be effective, it requires great precision of assembly and adjustment, and as a result necessitates that these operations be performed by qualified personnel.

SUMMARY OF THE INVENTION

An object of the invention is to improve the performances of this type of interface, i.e., to propose an improved device which, on the one hand, during the course of the bending of the ski, optimizes the zones of the ski whose mechanical characteristics are modified, and which, on the other hand, has a functioning mode that is highly progressive with the bending of the ski.

Another object of the invention is to propose an interface device which is simple to construct.

Another object is to propose a device which is simple to assemble and to adjust.

Other objects and advantages of the invention will appear during the course of the following description.

The interface device according to the invention includes a rear wedge with a mounting zone for a rear retention element, a front zone, and a rear zone; and a front wedge with a mounting zone for a front retention element, a front zone, and a rear zone, with the front zone of the rear wedge and the rear zone of the front wedge being adjacent. The zone adjacent to one of the wedges, denoted the first wedge, is provided to be assembled integrally with the ski, and the other wedge, denoted the second wedge, is mounted to float along the longitudinal direction defined by the ski. A plate is provided to be integrally connected to the ski is housed in a recess of the second floating wedge, that the second wedge has an inclined support surface provided to cooperate with an inclined contact surface of the plate in the event of displacement of the second wedge in the direction opposite to the first wedge, that the first and second wedges are connected by an inextensible link, that the two ends of the link are affixed to each of the wedges, that the distance between the attachment points of the link is adjustable, and that the link, once stretched between the wedges, enables moving the two wedges toward each other.

BRIEF DESCRIPTION OF DRAWINGS

The invention will be better understood with reference to the following description and to the annexed designs which constitute an integral part thereof, whereby.

DETAILED DESCRIPTION OF THE INVENTION

Figure 1:
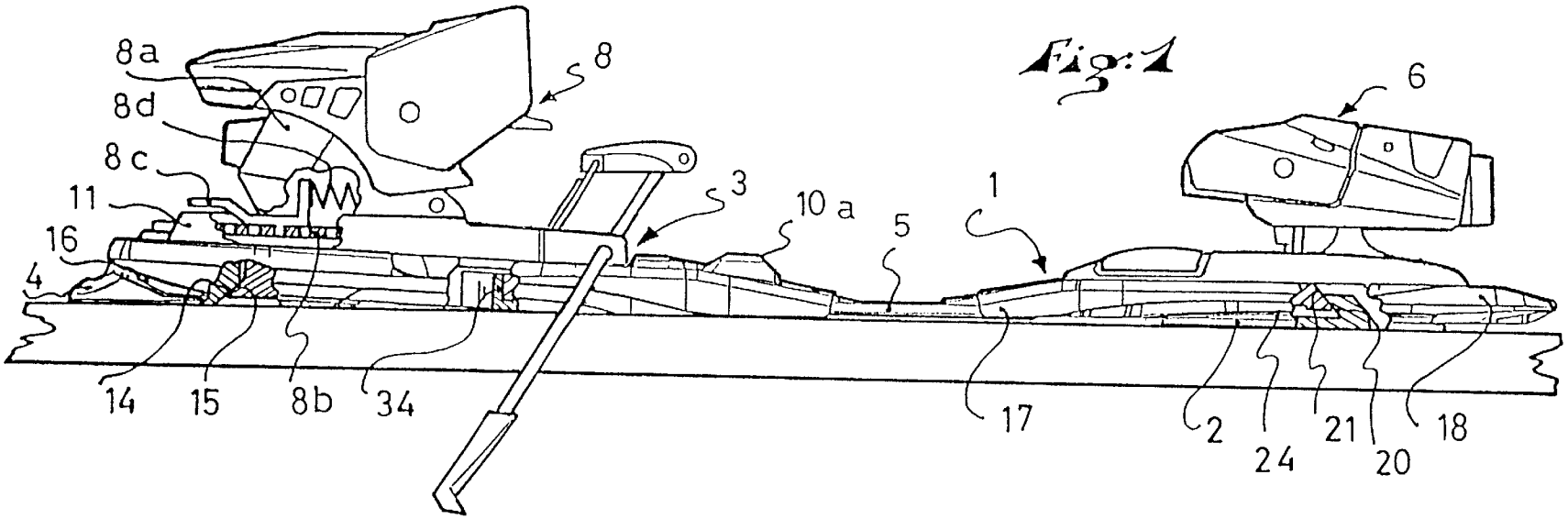
FIG. 1 is a side view of the interface device of the invention mounted on a ski and equipped with retention elements.
Figure 2:
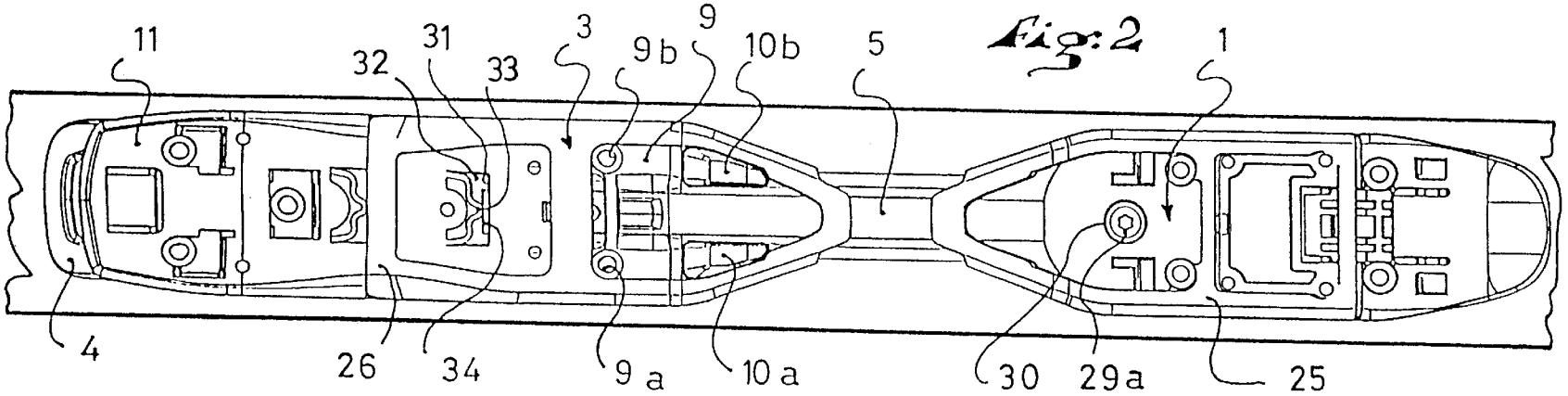
FIG. 2 is a top view of the device according to FIG. 1 without the retention elements.

According to the exemplary embodiment, the interface device has a front wedge 1, a front plate 2, a rear wedge 3, a rear plate 4, and a link 5.

The front wedge 1 is provided to bear a front retention element 6 and has on its top part a mounting zone provided for this element. The front wedge has the shape of a plate whose outline corresponds approximately to the outline of the base of a front retention element. The front retention element is of a known type. The mounting zone has an appropriate means to enable assembly of the retention element, for example, borings provided for the placement of binding screws of the retention element. Other means and methods of assembling the retention element can also be used.

Likewise, the rear wedge 3 has on its top part a mounting zone for a rear retention element 8 of any appropriate type. In a known manner, a rear retention element has a body 8*a* movable along a slide 8*b*. A bolt 8*c* or another means of attachment on the slide enables the adjustment of the longitudinal position of the body 8*a*. The body 8*a* may recoil in the direction of the bolt 8*c* against the return force of a compression spring 8*d* commonly referred to as a recoil spring.

When the interface device and the retention elements are assembled on a ski, the elements are raised to a height which corresponds to the thickness of the wedges. Although described herein as wedges, these components, as seen in the exemplary drawings, are not to be considered as being defined by particular shapes, such as a commonly understood tapered wedge shape. Instead, their shapes are determined as necessary to perform their described functions herein, positioned between the ski and the respective retention elements.

In the front zone 9, the rear wedge 3 is provided to be integrally connected to the ski. For example, as depicted, it has holes 9*a*, 9*b* for screws for affixing to the ski. Other affixing elements or methods could also be suitable, for example, gluing or welding.

Preferably, the rear wedge has in its front zone 9 two small protruding blocks 10*a* and 10*b* located along each lateral edge of the zone. The blocks are provided to support a support plate for the rear of the boot. The rear support plate is, for example, the maneuvering plate for braking the ski which is associated with the rear retention element 8. The blocks transmit the stresses from the boot to each lateral edge of the ski.

Also preferably, in its rear zone 11, the rear wedge 3 has a recess 12 which opens out at its bottom part. The rear plate 4 is partially housed in this recess. The plate 4 is provided to be integrally connected to the ski, for example, by screws, gluing, or welding. The rear plate 4 has a transverse surface inclined from front to back and from top to bottom. This surface is provided to cooperate with a complementary support surface 15 which the rear wedge has facing the recess 12.

An elastically compressible cushion 16 is inserted between the plate 4 and the rear wedge 3. The cushion is made, for example, of an elastomer. By way of example, good results were obtained with surfaces inclined approximately 50 degrees relative to the horizontal and an elastomer cushion of which the thickness varies from 2 to 5 millimeters. These values are not restrictive.

The cushion 16 holds the rear zone 11 slightly raised relative to the top surface of the ski when the ski is at rest.

When the assembly is mounted on a ski, the two surfaces 14 and 15 are pressed against each other. They cooperate like two ramps, and the cushion 16 holds the rear zone 11 slightly suspended above the plate 4. The front zone of the wedge is, in contrast, integrated with the ski. When the rear part of the ski bends upward, the plate tends to advance relative to the zone 11 of the wedge. Under the effect of the ramps 14 and 15, the zone 11 is pressed flat against the ski causing, in addition, the compression and shearing of the cushion 16.

The plate has, moreover, horizontal flanges 13*a*, 13*b*, 13*c*, 13*d*, which are engaged under corresponding flanges of the recess 12. These flanges ensure, among each other, the vertical retention of the zone 11 of the wedge relative to the plate. When the wedge is assembled on the plate at rest, the flanges rest one on top of another. At the time of a relative displacement of the wedge and the plate in a longitudinal direction, the flanges separate from each other.

In a transverse direction, the recess and the plate substantially have the same dimensions. In this manner, the wedge is held by the plate in a transverse direction.

The front wedge 1 has a front zone 18, a rear zone 17, and a recess 19 located in its central zone. The plate 2 is housed in the recess 19. The plate 2 is provided to be integrally connected to the ski. It has transverse dimensions equal to those of the recess 19. The plate 2 guides the wedge 1, obstructing transverse movement by permitting a longitudinal movement of low magnitude.

The plate has a transverse surface 20 which is inclined from back to front and from top to bottom. This surface cooperates with a surface 21 of the wedge which has an identical inclination. An elastically compressible cushion 24 is inserted between the wedge 1 and the plate 2. The cushion holds the wedge slightly raised relative to the ski when the ski is at rest. By way of example, good results have been obtained with surfaces inclined approximately 40 degrees relative to the horizontal and a cushion with a thickness of 2 millimeters.

Preferably, the plate 2 has flanges 22*a*, 22*b*, 22*c*, 22*d* which are engaged under complementary flanges of the recess 19. These flanges ensure, among each other, vertical retention of the wedge 1 on the plate 2. These flanges operate in the same manner as those of the rear wedge.

The front wedge is mounted to float relative to the plate 2 and to the ski along the longitudinal direction defined by the ski. When the ski is at rest, the wedge 1 is slightly raised relative to the top surface of the ski.

With front displacement of the wedge 1 relative to the plate 2, the wedge is pressed flat against the ski by the ramps 20 and 21; moreover, it causes the compression and shearing of the cushion 24.

Covering caps, or covers, 25 and 26 are also provided to cover the front and rear wedges 1 and 3.

The front and rear wedges 1 and 3 are connected by a link 5. The link 5 is inextensible. It is connected by its two ends 27 and 28 to each of the wedges. The link 5 nevertheless enables a relative moving of the two wedges toward each other. For this, either the link is flexible, and it expands, or, as described in the following, one of the ends of the link may be displaced relative to the wedge to which it is attached.

The link 5 is depicted in FIG. 1 in the form of a metal plate. The front end 27 of the plate has a longitudinal slot in which a screw-nut system composed of three parts 29*a*, 29*b*, 29*c* is engaged and tightened. The attachment of the end 27 to the front wedge is achieved by the engagement of the head 29*a* of the screw-nut system in a housing 30 located in the rear zone 17 of the wedge 1. Elastic tabs are provided to partially confine the washer 29*b* and the nut 29*c*.

The longitudinal position of the screw-nut system can be adjusted along the slot.

The rear end 28 of the plate has an upstanding tab 34. This tab is provided to press against the surface 31 of a housing 32 of the rear wedge 3. The housing has a longitudinal dimension greater than that of the tab. It enables the tab 34 and thus the end 28 of the link to recoil relative to the wedge. Preferably, the housing 32 has an elastic lamella 33 which elastically presses the tab 34 flat against the surface 31 of the housing. The role of this lamella will be described in the following.

In the exemplary embodiment, the rear wedge 3 has two other housings 35 and 36 identical to the housing 32, but off-set in a longitudinal direction. One or a plurality of other housings could also be provided.

Figure 3:
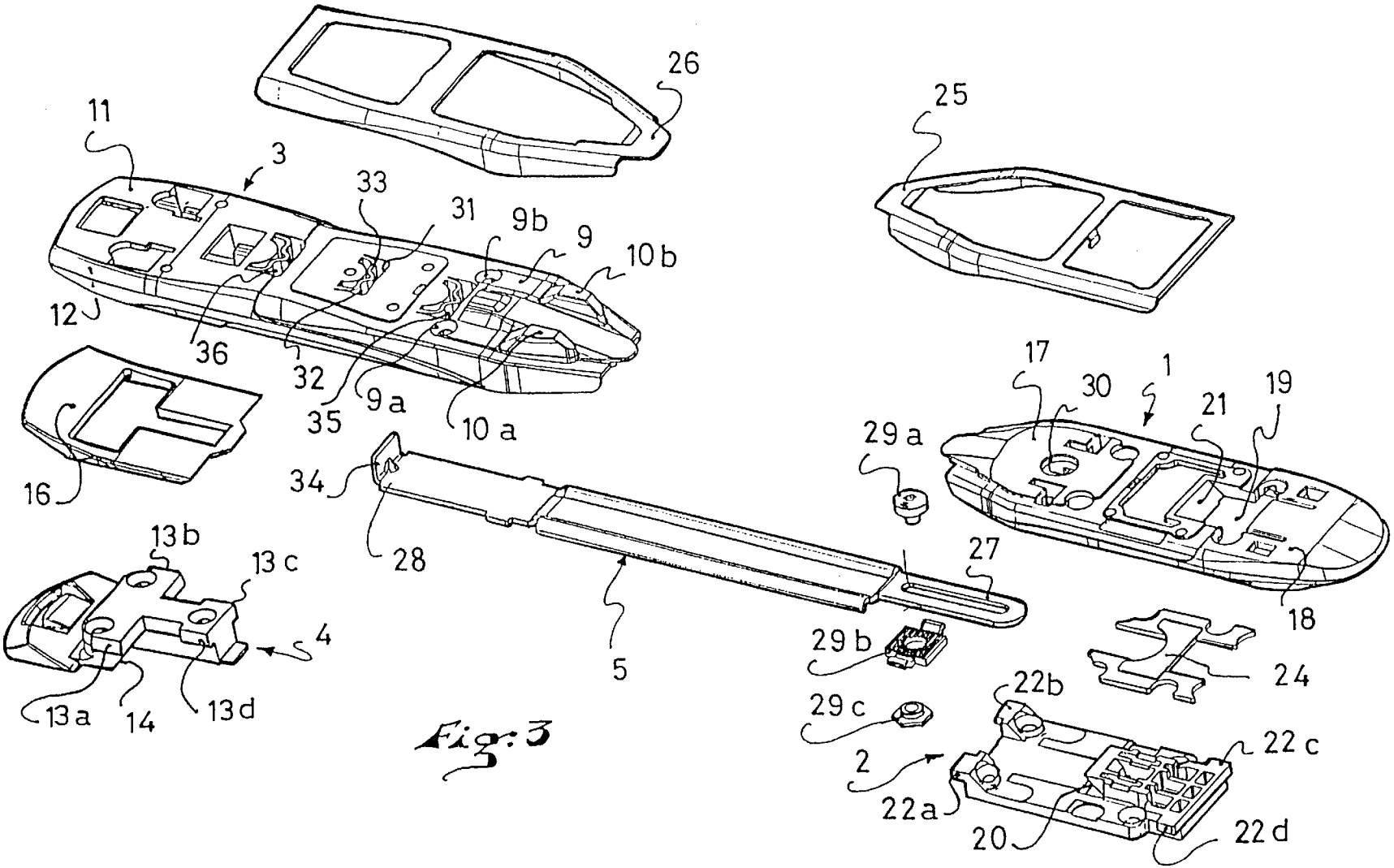
FIG. 3 is an exploded perspective view of the interface device.

The mounting of the device on the ski is achieved as follows. The interface device is packaged as a front sub-assembly including the front wedge, the front plate, and the cushion; a rear sub-assembly including the rear wedge, the rear plate, and the cushion; and the link. For the two sub-assemblies, the plates are assembled to the wedges, and they are held by the interaction of the flanges. The ramps are in contact with each other. As discernible in FIG. 3, the front and rear wedges advantageously have borings which enable access to the binding screws of the plates. In other words, these borings are positioned facing the holes in the plates in which the binding screws are engaged.

The placements of the plates 2 and 4 on the ski are pre-determined according to the length of the boot. The ski is bored to accommodate the plates, as well as the binding screws of the front zone 9 of the wedge 3.

The link 5 is attached to the front sub-assembly, i.e., the head of the screw 29*a* is engaged in the boring 30, but the nut-screw system which passes through the slot of the front end 27 of the link is not tightened and can slide along the slot. The tab 34 is engaged in one of the housings 32, 35, 36 depending on the length of the boot.

The device thus assembled is placed on the ski, and the binding screws of plates and of the front zone 9 are tightened. The screw 29*a* of the nut-screw system is then tightened. In this regard, it must be emphasized that the purpose of the elastic lamella which equips each housing 32, 35 or 36 is to press the tab 34 of the link flat against the support surface of the housing to ensure that at the time of the tightening of the screw 29*a,* the tab is correctly positioned in its housing.

The front and rear retention elements are then fixed to the front and rear wedges. If necessary, the position of the rear retention element is adjusted by means of its own length adjustment device.

The functioning of the device is the following. Upon engagement of the boot, the boot is gripped between the retention elements because of the thrust of the recoil spring 8*d.*

The reaction to this thrust passes into the link 5 so that the ski is unaffected by this reaction.

When the ski bends, it is known that the ski behaves like a bow, and the boot like the bowstring. First, the front wedge 1 is displaced forward. In doing so, it is pressed flat against the ski and it compresses the cushion 24. The reaction to the recoil thrust continues to pass through the link. This continues until the front wedge meets resistance to its advance which is greater than the thrust of the recoil spring. Then, the tab 34 stops pressing against the support surface of its housing and recoils into the housing. The body of the rear retention element recoils in the slide, increasing the compression of the recoil spring and the intensity of the thrust. Because of the separation of the tab 34, the reaction to this thrust is transferred from the link 5 into the ski.

The present description is provided only by way of example, and other implementations of the invention could be adopted without leaving the scope of the invention. In particular, it would be possible to reverse the method of connecting the two front and rear wedges to the ski, i.e., to affix the rear end of the front wedge integrally to the ski, and to mount the rear wedge in a floating manner. It would likewise be possible to implement flexible but inextensible links, such as a cable. Other variants are possible.

What is claimed is:

1. An interface device adapted to be affixed onto a ski, said interface device comprising:

a front wedge with a mounting zone for a front retention element, said mounting zone of said front wedge comprising a front zone and a rear zone;

a rear wedge with a mounting zone for a rear retention element, said mounting zone of said rear wedge comprising a front zone and a rear zone;

said front zone of said rear wedge and said rear zone of said front wedge being adjacent to each other;

one of said front and rear wedges constituting a first wedge and another of said front and rear wedges constituting a second wedge, at least a part of said first wedge being adapted to be integrally fixed with respect to the ski, said second wedge being adapted to be mounted to float in a longitudinal direction defined by the ski;

a plate adapted to be integrally fixed with respect to the ski being housed in a recess of said second wedge, said plate having an inclined contact surface;

said second wedge having an inclined surface positioned in cooperation with said inclined contact surface of said plate during displacement of said second wedge in a direction opposite to said first wedge;

an inextensible link connecting said first and second wedges, said inextensible link having first and second ends attached to said first and second wedges, respectively;

an attachment point between said link and one of said first and second wedges being adjustable in position along said link; and said link, once in a use position between said wedges, permitting a relative movement of said first and second wedges toward each other.

2. An interface device according to claim 1, wherein a cushion made of elastically compressible material is inserted between said plate and said second, floating wedge.

3. An interface device according to claim 1, wherein said link is a metal plate and one of the ends is attached by a nut-screw system tightened in a slot located at one end of the plate.

4. An interface device according to claim 1, wherein the link is a metal plate and one of the ends is attached by a fold of the plate pressed against a support surface of a housing of one of the wedges.

5. An interface device according to claim 4, wherein an elastic lamella presses the fold of the plate flat against the surface of the housing.

6. An interface device according to claim 1, wherein the first wedge is the rear wedge.

7. An interface device according to claim 6, wherein the rear wedge has in its rear zone an inclined support surface which presses against an inclined transverse surface of a plate provided to be integrally connected to the ski.

8. An interface device according to claim 7, wherein an elastically deformable cushion is interposed between the plate and the wedge.

9. An assembly adapted to be positioned upon a ski, said assembly comprising:

a front binding and a rear binding; and an interface device adapted to be affixed onto a ski, said interface device comprising:

a front wedge with a mounting zone for said front binding, said mounting zone of said front wedge comprising a front zone and a rear zone;

a rear wedge with a mounting zone for said rear binding, said mounting zone of said rear wedge comprising a front zone and a rear zone;

said front zone of said rear wedge and said rear zone of said front wedge being adjacent to each other;

one of said front and rear wedges constituting a first wedge and another of said front and rear wedges constituting a second wedge, at least a part of said first wedge being adapted to be integrally fixed with respect to the ski, said second wedge being adapted to be mounted to float in a longitudinal direction defined by the ski;

a plate adapted to be integrally fixed with respect to the ski being housed in a recess of said second wedge, said plate having an inclined contact surface;

said second wedge having an inclined surface positioned in cooperation with said inclined contact surface of said plate during displacement of said second wedge in a direction opposite to said first wedge;

an inextensible link connecting said first and second wedges, said inextensible link having first and second ends attached to said first and second wedges, respectively;

an attachment point between said link and one of said first and second wedges being adjustable in position along said link; and said link, once in a use position between said wedges, permitting a relative movement of said first and second wedges toward each other.

10. A ski assembly comprising:

a longitudinally extending ski;

a front binding and a rear binding; and an interface device to be affixed onto said ski, said interface device comprising:

a front wedge with a mounting zone for said front binding, said mounting zone of said front wedge comprising a front zone and a rear zone;

a rear wedge with a mounting zone for said rear binding, said mounting zone of said rear wedge comprising a front zone and a rear zone;

said front zone of said rear wedge and said rear zone of said front wedge being adjacent to each other;

one of said front and rear wedges constituting a first wedge and another of said front and rear wedges constituting a second wedge, at least a part of said first wedge to be integrally fixed with respect to said ski, said second wedge being mounted to float in a longitudinal direction defined by said ski;

a plate to be integrally fixed with respect to said ski being housed in a recess of said second wedge, said plate having an inclined contact surface;

said second wedge having an inclined surface positioned in cooperation with said inclined contact surface of said plate during displacement of said second wedge in a direction opposite to said first wedge;

an inextensible link connecting said first and second wedges, said inextensible link having first and second ends attached to said first and second wedges, respectively;

an attachment point between said link and on of said first and second wedges being adjustable in position along said link; and said link, once in a use position between said wedges, permitting a relative movement of said first and second wedges toward each other.

* * * * *